US012292261B2

(12) United States Patent
Hyun et al.

(10) Patent No.: US 12,292,261 B2
(45) Date of Patent: May 6, 2025

(54) METHOD OF DETERMINING TOPOGRAPHICAL INTERFERENCE WITH GUIDED MISSILE AND DETERMINATION APPARATUS THEREFOR

(71) Applicant: AGENCY FOR DEFENSE DEVELOPMENT, Daejeon (KR)

(72) Inventors: Dai Kyung Hyun, Daejeon (KR); Jin Seo Park, Daejeon (KR); Ye Jun Kang, Daejeon (KR)

(73) Assignee: AGENCY FOR DEFENSE DEVELOPMENT, Daejeon (KR)

( * ) Notice: Subject to any disclaimer, the term of this patent is extended or adjusted under 35 U.S.C. 154(b) by 0 days.

(21) Appl. No.: 18/482,668

(22) Filed: Oct. 6, 2023

(65) Prior Publication Data

US 2024/0247913 A1 Jul. 25, 2024

(30) Foreign Application Priority Data

Nov. 28, 2022 (KR) ..... 10-2022-0161752

(51) Int. Cl.
*F41G 7/34* (2006.01)

(52) U.S. Cl.
CPC ..... *F41G 7/34* (2013.01)

(58) Field of Classification Search
CPC ..... F41G 7/34; F41G 7/343; F41G 7/22
USPC ..... 235/401
See application file for complete search history.

(56) References Cited

U.S. PATENT DOCUMENTS

| | | | | |
|---|---|---|---|---|
| 6,279,851 | B1 * | 8/2001 | Huss | F41G 7/22 342/63 |
| 11,448,483 | B1 * | 9/2022 | Curzan | G06T 11/00 |
| 2012/0153071 | A1 * | 6/2012 | Kesselring | H01Q 1/28 244/3.15 |
| 2016/0195878 | A1 * | 7/2016 | Peleg | F41G 7/008 244/3.11 |
| 2016/0216075 | A1 * | 7/2016 | Trail | F41G 7/2293 |
| 2020/0166311 | A1 * | 5/2020 | Kolanek | G05D 1/106 |
| 2024/0200903 | A1 * | 6/2024 | Zemany | F42B 15/01 |

FOREIGN PATENT DOCUMENTS

KR 10-2061857 B1 1/2020

* cited by examiner

*Primary Examiner* — Ahshik Kim
(74) *Attorney, Agent, or Firm* — Knobbe, Martens, Olson & Bear, LLP

(57) ABSTRACT

A method of determining topographical interference with a guided missile is proposed. The method may include obtaining a pre-calculated expected trajectory of a guided missile. The method may also include extracting topographic elevations with respect to a topography corresponding to the pre-calculated expected trajectory from stored topographical information. The method may further include determining presence or absence of topographical interference with the guided missile based on bottom trajectory elevation values in the pre-calculated expected trajectory and topographic elevation values corresponding to the bottom trajectory elevation values. The pre-calculated expected trajectory may include top, bottom, left, and right trajectories with respect to a launch direction of the guided missile, calculated based on an error factor for the guided missile, and the error factor includes manufacturing error values with respect to at least one of a weight, center of gravity, a thrust, or a moment of inertia of the guided missile.

20 Claims, 6 Drawing Sheets

METHOD OF DETERMINING TOPOGRAPHICAL INTERFERENCE WITH GUIDED MISSILE AND DETERMINATION APPARATUS THEREFOR

CROSS-REFERENCE TO RELATED APPLICATION

This application claims priority to Korean Patent Application No. 10-2022-0161752, filed on Nov. 28, 2022. The entire contents of the application on which the priority is based are incorporated herein by reference.

BACKGROUND

Technical Field

The present disclosure relates to a method of determining topographical interference with a guided missile and a determination apparatus therefor capable of controlling missile launch by determining topographical interference with an air-to-ground guided missile in real time in a launcher such as a helicopter.

Description of Related Technology

A guided missile is a type of missile that is launched from a launcher and flies toward a target. Such guided missiles are classified as air-to-surface guided missiles, ground-to-ground guided missiles, ground-to-air guided missiles, and the like based on the shape or operation method of the launcher.

SUMMARY

An object of the present disclosure is to provide a method of determining topographical interference with a guided missile and a determination apparatus therefor capable of controlling missile launch by determining topographical interference with an air-to-ground guided missile in real time in a launcher such as a helicopter.

In accordance with a first aspect, a method of determining topographical interference with a guided missile to be performed by an apparatus for determining topographical interference with a guided missile, the method comprising: obtaining a pre-calculated expected trajectory information of a guided missile; extracting topographic elevations with respect to a topography corresponding to the pre-calculated expected trajectory information from stored topographical information; and determining presence or absence of topographical interference with the guided missile based on a plurality of bottom trajectory elevation values in the pre-calculated expected trajectory information and a plurality of topographic elevation values of the topographic elevations corresponding to the plurality of bottom trajectory elevation values, wherein the pre-calculated expected trajectory information includes a top trajectory, a bottom trajectory, a left trajectory, and a right trajectory with respect to a launch direction of the guided missile, calculated based on one or more error factors for the guided missile, and the one or more error factors are manufacturing error values with respect to at least one of a weight, center of gravity, a thrust, and a moment of inertia of the guided missile.

In accordance with a second aspect, an apparatus for determining topographical interference with a guided missile, comprising: a memory in which a topographical interference determination program for determining presence or absence of topographical interference with a guided missile; and a processor configured to execute the topographical interference determination program to obtain a pre-calculated expected trajectory information of the guided missile, to extract topographic elevations with respect to a topography corresponding to the pre-calculated expected trajectory information from among stored topographical information, and to determine presence or absence of topographical interference with the guided missile based on a plurality of bottom trajectory elevation values in the pre-calculated expected trajectory information and a plurality of topographic elevation values of the topographic elevations corresponding to the plurality of bottom trajectory elevation values, wherein the pre-calculated expected trajectory information includes a top trajectory, a bottom trajectory, a left trajectory, and a right trajectory with respect to a launch direction of the guided missile, calculated based on one or more error factors for the guided missile, and the one or more error factors are manufacturing error values with respect to at least one of a weight, center of gravity, a thrust, and a moment of inertia of the guided missile.

In accordance with a third aspect, a non-transitory computer-readable storage medium storing a computer program, the computer program comprising: obtaining a pre-calculated expected trajectory information of a guided missile; extracting topographic elevations with respect to a topography corresponding to the pre-calculated expected trajectory information from stored topographical information; and determining presence or absence of topographical interference with the guided missile based on a plurality of bottom trajectory elevation values in the pre-calculated expected trajectory information and a plurality of topographic elevation values of the topographic elevations corresponding to the plurality of bottom trajectory elevation values, wherein the pre-calculated expected trajectory information includes a top trajectory, a bottom trajectory, a left trajectory, and a right trajectory with respect to a launch direction of the guided missile, calculated based on one or more error factors for the guided missile, and the one or more error factors are manufacturing error values with respect to at least one of a weight, center of gravity, a thrust, and a moment of inertia of the guided missile.

According to the present disclosure, it is possible to determine presence or absence of interference between a guided missile and a topography in advance before launching the guided missile based on information on a pre-calculated expected trajectory of the missile and topographical information on a launch area.

Accordingly, a launcher that launches a guided missile can adjust a launch angle of the guided missile or stop launching depending on results of determining topographical interference with the guided missile, and thus it is possible to prevent the launched guided missile from being lost due to topographical interference before reaching a target on the ground.

The problem to be solved by the present disclosure is not limited to those described above, and another problem to be solved that is not described may be clearly understood by those skilled in the art to which the present disclosure belongs from the following description.

DETAILED DESCRIPTION

Figure 1:
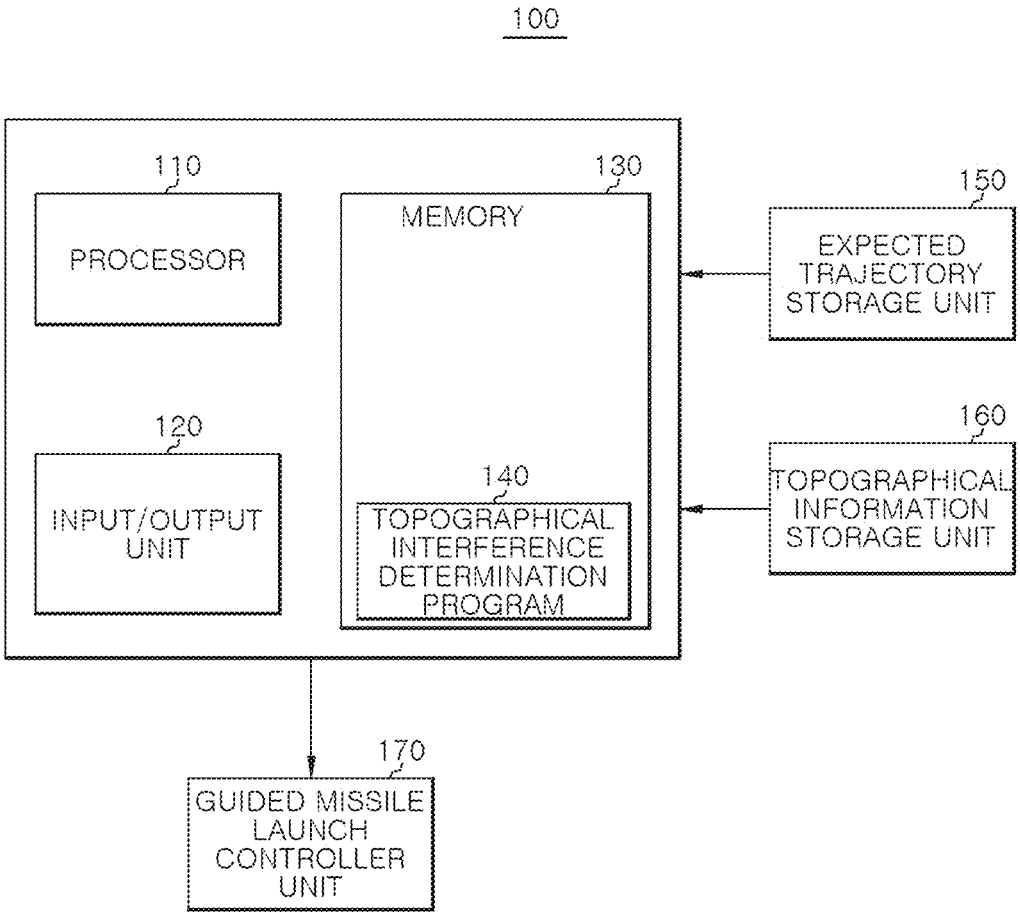
FIG. 1 is a block diagram illustrating an apparatus for determining topographical interference with a guided missile according to an embodiment of the present disclosure.

In a case where an air-to-ground missile is launched from a launcher of an air vehicle, such as a helicopter, toward a ground target, there is a high possibility that the missile might be lost due to ground topography interference before reaching the target.

Consequently, a problem arises where the guided missile intercept a point other than the target's location or exposing a friendly launcher's location (like a helicopter) to the enemy, thereby increasing the risk of being shot down.

Korean Patent No. 10-2061857 discloses an apparatus and method for estimating a flight trajectory of a guided missile which generate a reference trajectory by reflecting calculated impact point navigation errors in navigation trajectory information on the initial starting point to the impact point of the guided missile, output from an inertial navigation device mounted on the missile.

However, the above guided missile flight trajectory estimation apparatus estimates a trajectory according to the flight of a missile after the missile is launched by a flight test. This approach makes it challenging to apply the apparatus to determine whether to launch a missile in urgent situations such as in battlefield or mission performance.

The above and other objectives, features, and advantages of the present disclosure will be easily understood from the following preferred embodiments in conjunction with the accompanying drawings. However, the present disclosure may be embodied in different forms without being limited to the embodiments set forth herein. Rather, the embodiments disclosed herein are provided to make the disclosure thorough and complete and to sufficiently convey the spirit of the present disclosure to those skilled in the art. The scope of the present disclosure is merely defined by the claims.

In the following description of the present disclosure, detailed descriptions of known functions and configurations which are deemed to make the gist of the present disclosure obscure will be omitted. Since the terms can be differently defined according to the intention of a user or an operator or customs, these terms should be interpreted as having a meaning that is consistent with the technical spirit of the present disclosure.

The functional blocks shown in the drawings and described below are only possible implementations. Other functional blocks may be used in other implementations without departing from the spirit and scope of the detailed description. In addition, while one or more functional blocks of the present disclosure are represented as individual blocks, one or more of the functional blocks of the present disclosure may be a combination of various hardware and software configurations that perform the same function.

Further, the expression "certain components are included" simply indicates that corresponding components are present, as an open expression, and should not be understood as excluding additional components.

Furthermore, it should be understood that when an element is referred to as being "coupled" or "connected" to another element, it can be directly coupled or connected to the other element or intervening elements may be present therebetween.

Further, it will be understood that the terms "first", "second", etc. are used herein to distinguish one element from another element, these terms do not limit the order or other features between the elements.

Hereinafter, the embodiments of the present disclosure will be described with reference to the accompanying drawings.

FIG. 1 is a block diagram showing an apparatus for determining topographical interference with a guided missile according to an embodiment of the present disclosure.

Referring to FIG. 1, the apparatus 100 for determining topographical interference with a guided missile (hereinafter referred to as a topographical interference determination apparatus) of the present embodiment may determine in advance whether or not interference occurs due to a topography on a movement route of the guided missile before a launcher (LM in FIG. 4) launches the guided missile to a target (Target in FIG. 4). The topographical interference determination apparatus 100 may control guided missile launching of the launcher LM according to the determination result.

Hereinafter, for convenience of description, it is assumed that the launcher LM is an air vehicle such as a helicopter, a guided missile is an air-to-ground missile launched from the air vehicle to a target on the ground, and the topographical interference determination apparatus 100 of the present embodiment determines presence or absence of topographical interference with the air-to-ground guided missile before the helicopter launches the air-to-ground missile. However, the present disclosure is not limited thereto, the launcher LM may be a ground mobile body such as a vehicle, a guided missile may be a ground-to-ground missile launched from the ground mobile body to a target on the ground, and the topographical interference determination apparatus 100 of the present embodiment may determine presence or absence of topographical interference with the ground-to-ground guided missile before the mobile body launches the ground-to-ground missile.

The topographical interference determination apparatus 100 may include a processor 110, an input/output unit 120, and a memory 130.

The processor 110 may control overall operations of the topographical interference determination apparatus 100. The processor 110 may receive information on an expected trajectory of a guided missile and topographical information on a launch area of the guided missile through the input/output unit 120 and determine presence or absence of topographical interference with the guided missile using a topographical interference determination program 140 stored in the memory 130 which will be described later.

In addition, the processor 110 may output a predetermined launch control signal to a guided missile launch controller unit 170 of the launcher LM according to the determination result to control guided missile launch of the launcher LM.

The input/output unit 120 may receive information on an expected trajectory of a guided missile from an expected trajectory storage unit 150 and topographical information on a missile launch area from a topographical information storage unit 160. When the topographical interference determination program 140 is executed by the processor 110, the input/output unit 120 may provide previously received expected trajectory information and topographical information to the processor 110.

Here, the expected trajectory storage unit 150 may be included in an electronic device (not shown) of a guided missile. Information on an expected trajectory of the guided missile may be stored in the expected trajectory storage unit 150, and after the guided missile is loaded in the launcher LM, the stored expected trajectory information may be output to the input/output unit 120 of the topographical interference determination apparatus 100.

Such expected trajectory information may include a top trajectory, a bottom trajectory, a left trajectory, and a right trajectory with respect to a launch direction of the guided missile.

In addition, the pre-calculated expected trajectory information may be calculated based on one or more error factors generated in the manufacturing process of the guided missile. For example, the pre-calculated expected trajectory information may be calculated through a Monte Carlo simulation using one or more error factors of the guided missile.

Here, since a simulation for calculating information on an expected trajectory of a guided missile takes a long time, the pre-calculated expected trajectory information may be calculated using a separate high-performance computing device (not shown) at the time when manufacturing of the guided missile is completed and included in a database included in the electronic device of the guided missile, that is, the expected trajectory storage unit 150.

Here, one or more error factors of a guided missile may be generated from error values between design target values and actual manufactured values in the missile manufacturing process. These error factors may be error values for at least one of the weight, center of gravity, thrust, and moment of inertia of the guided missile.

In addition, the topographical information storage unit 160 may be included in the launcher LM or may be included in an external server (not shown) that may be connected to the launcher LM through communication. The topographical information storage unit 160 may store topographical information on a plurality of areas where guided missiles may be used. The topographical information storage unit 160 may output topographical information on the area where the launcher LM is located to the input/output unit 120 of the topographical interference determination apparatus 100 based on the location coordinates of the launcher LM.

For example, in a case in which the topographical information storage unit 160 is included in the launcher LM, the topographical interference determination apparatus 100 of the present embodiment may obtain the current location coordinates of the launcher LM through a GPS sensor (not shown) or the like and receive topographical information on the corresponding area from the topographical information storage unit 160 through the input/output unit 120 on the basis of the current location coordinates.

In addition, in a case in which the topographical information storage unit 160 is included in an external server, the topographical interference determination apparatus 100 may transmit the current location coordinates of the launcher LM obtained through a GPS sensor to the external server through the input/output unit 120 and receive topographical information on the corresponding area from the external server through the input/output unit 120.

Here, the topographical information may be pictures or images including a topography or obstacles such as buildings in the corresponding area. Further, the topographical information may include altitude information on a topography or an obstacle, that is, an altitude value.

The memory 130 of the topographical interference determination apparatus 100 may store the topographical interference determination program 140 and information required to execute the topographical interference determination program 140. The topographical interference determination program 140 of the present embodiment may be software including a plurality of instructions programmed to determine presence or absence of interference due to a topography at the time of launching a guided missile based on information on an expected trajectory of the guided missile and topographical information on a launch area.

Accordingly, the processor 110 may load and execute the topographical interference determination program 140 from the memory 130 and determine whether or not the guided missile interferes with a topography from the information on an expected trajectory of the guided missile and the topographical information on the launch area.

Here, the processor 110 may load and execute the topographical interference determination program 140 after the guided missile is loaded in the launcher LM and before the guided missile is launched, and determine presence or absence of topographical interference when the guided missile is launched from the information on an expected trajectory of the guided missile and the topographical information of the launch area provided through the input/output unit 120.

Figure 2:
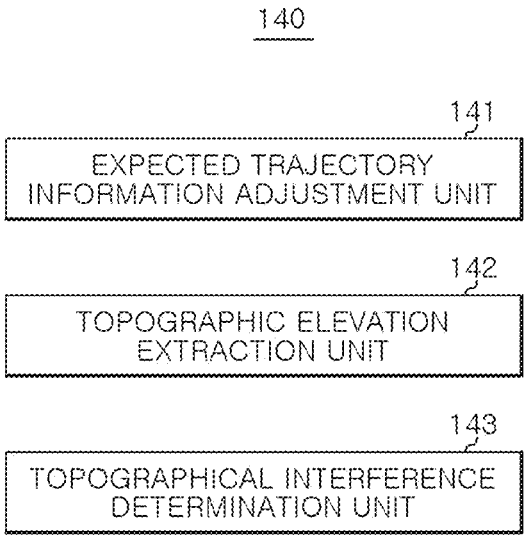
FIG. 2 is a block diagram conceptually illustrating the function of a topographical interference determination program of FIG. 1.

FIG. 2 is a block diagram conceptually illustrating the function of the topographical interference determination program of FIG. 1.

Referring to FIG. 2, the topographical interference determination program 140 according to the present embodiment may include an expected trajectory information adjustment unit 141, a topographic elevation extraction unit 142, and a topographical interference determination unit 143.

The pre-calculated expected trajectory information adjustment unit 141, the topographic elevation extraction unit 142, and the topographical interference determination unit 143 shown in FIG. 2 are conceptually divided to easily describe the function of the topographical interference determination program 140, and the present disclosure is not limited thereto.

For example, according to an embodiment of the present disclosure, the functions of the pre-calculated expected trajectory information adjustment unit 141, the topographic elevation extraction unit 142, and the topographical interference determination unit 143 may be merged or separated, and they may be realized by a series of instructions included in one program.

The pre-calculated expected trajectory information adjustment unit 141 may adjust previously received information on an expected trajectory of a guided missile on the basis of a distance between a launch point of the guided missile, that is, the current location of the launcher LM, and a target.

As described above, information on an expected trajectory of a guided missile may be calculated based on various error factors generated in the missile manufacturing process. Accordingly, the pre-calculated expected trajectory information may include information on a trajectory of a guided missile between a virtually set launch point and a target.

Accordingly, the pre-calculated expected trajectory information adjustment unit 141 of the present embodiment may adjust and output expected trajectory information according to the distance between the target and the actual launch time of the guided missile. Here, the adjusted expected trajectory information may include trajectories in upward/downward/leftward/rightward directions between the launcher LM, that is, the guided missile launch point and the target.

The topographic elevation extraction unit 142 may extract a topographic elevation of the launch area of the guided missile based on the information on an expected trajectory of the guided missile output from the pre-calculated expected trajectory information adjustment unit 141 and previously received topographical information. Here, the extracted topographic elevation may include topographic elevation values for a plurality of points.

The topographic elevation extraction unit 142 may extract information on an expected trajectory of the guided missile, for example, a topography corresponding to the launch direction of the guided missile, from the topographical information. Here, the topographic elevation extraction unit 142 may extract topographical information corresponding to an area between a left trajectory and a right trajectory among the pre-calculated expected trajectory information from the topographical information, and extract the corresponding topography therefrom.

Further, the topographic elevation extraction unit 142 may divide the extracted topography at regular intervals, for example, at intervals of 1 to 10 m. Here, the topographic elevation extraction unit 142 may divide the topography into a plurality of regions by drawing a plurality of virtual division lines at regular intervals in a direction crossing the launch direction of the guided missile in the extracted topography.

In addition, the topographic elevation extraction unit 142 may extract a topographic elevation value for each divided topography region, that is, a topographic elevation including an elevation value for the topography corresponding to each of the plurality of division points.

The topographical interference determination unit 143 may determine presence or absence of topographical interference when the guided missile is launched on the basis of the pre-calculated expected trajectory information and the topographic elevation.

As described above, the pre-calculated expected trajectory information includes a bottom trajectory of the guided missile, and the topographical interference determination unit 143 may extract a plurality of bottom trajectory elevation values from the bottom trajectory of the pre-calculated expected trajectory information.

Accordingly, the topographical interference determination unit 143 may compare the plurality of bottom trajectory elevation values with a plurality of topographic elevation values of the topographic elevation corresponding thereto to determine topographical interference with respect to the guided missile.

For example, the topographical interference determination unit 143 may determine topographical interference with respect to the guided missile when at least one pair of elevation values corresponding to each other among the plurality of bottom trajectory elevation values and the plurality of topographic elevation values matches, that is, when they are substantially the same.

Further, the topographic interference determination unit 143 may determine topographical interference with respect to the guided missile when the difference between each of the plurality of bottom trajectory elevation values and each of the plurality of topographic elevation values corresponding thereto is a negative number.

Further, the topographical interference determination unit 143 may calculate distances between the plurality of bottom trajectory elevation values and the plurality of topographic elevation values corresponding thereto and compare the calculated plurality of distances with a preset reference value. If at least one of a plurality of distances is equal to or less than the reference value as a comparison result, the topographical interference determination unit 143 may determine topographical interference with respect to the guided missile. In this case, the reference value may be a trajectory error margin and may be set in consideration of the weather condition of the missile launch area.

Referring back to FIG. 1, the processor 110 may execute the topographical interference determination program 140 to generate a predetermined launch control signal according to the result of determination of topographical interference with the guided missile.

Accordingly, the processor 110 may output the launch control signal to the guided missile launch controller unit 170 of the launcher LM to control guided missile launch of the launcher LM. For example, the guided missile launch controller unit 170 may control the launch angle of the guided missile or stop launch based on the launch control signal.

As described above, the apparatus 100 for determining topographical interference with a guided missile according to the present embodiment can determine presence or absence of topographical interference with the guided missile in advance before launching the guided missile based on information on an expected trajectory of the guided missile and topographical information on a launch area.

Accordingly, the launch angle of the guided missile can be controlled or launch can be stopped based on the result of determination of topographical interference with the guided missile in the launcher LM, and thus it is possible to prevent the launched missile from being lost due to topographical interference before reaching a target on the ground.

Figure 3:
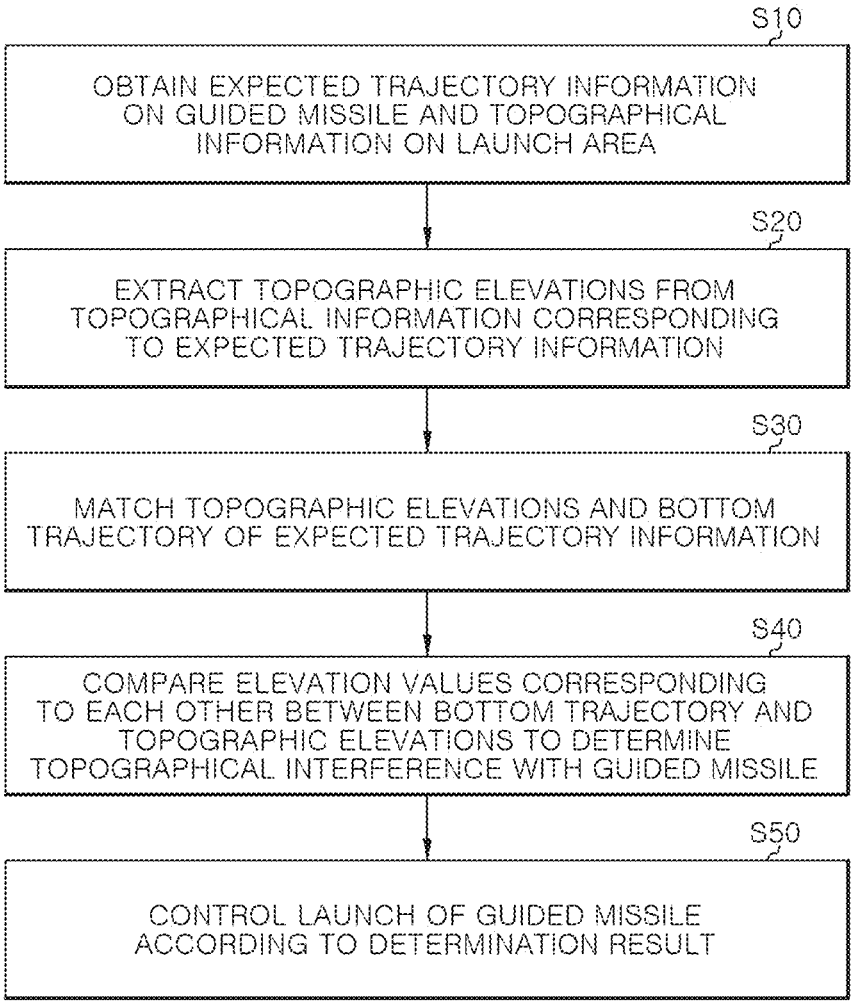
FIG. 3 is a flowchart illustrating a method of determining topographical interference with a guided missile according to an embodiment of the present disclosure.
Figure 4:
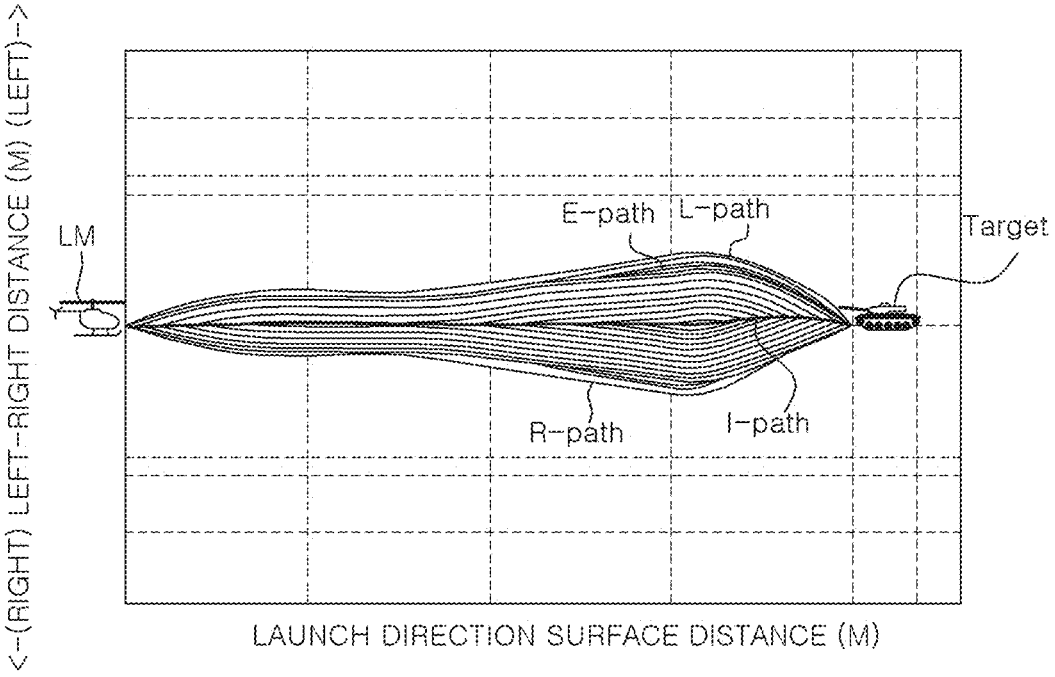
FIGS. 4 to 6 are diagrams illustrating various embodiments of the method of determining topographical interference with a guided missile according to the present disclosure.
Figure 5:
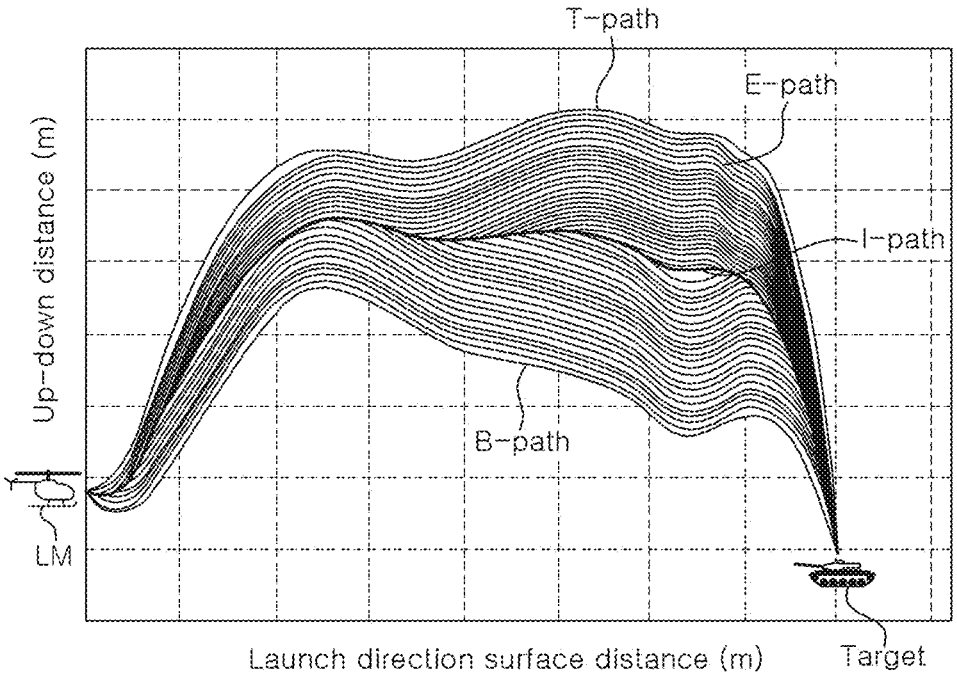
Figure 6:
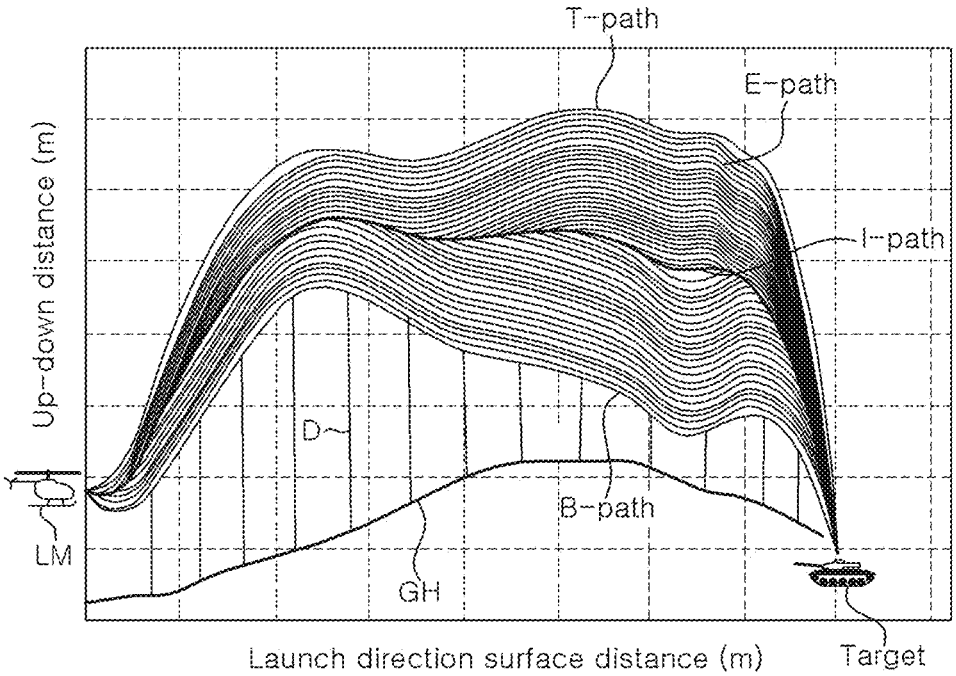

FIG. 3 is a flow chart illustrating a method of determining topographical interference with a guided missile according to an embodiment of the present disclosure, and FIGS. 4 to 6 are diagrams illustrating various embodiments of the method of determining topographical interference with a guided missile according to the present disclosure.

Referring to FIG. 3, the processor 110 of the topographical interference determination apparatus 100 may receive information on an expected trajectory of a guided missile and topographical information on a guided missile launch area from the expected trajectory storage unit 150 and the topographical information storage unit 160 through the input/output unit 120 (S10).

The expected trajectory storage unit 150 may be included in the electronic device of the guided missile. Accordingly, the processor 110 may acquire information on an expected trajectory of the guided missile from the expected trajectory storage unit 150 after the guided missile is loaded in the launcher LM.

Here, the information on an expected trajectory of the guided missile may be calculated through a simulation based on one or more error factors generated in the guided missile manufacturing process. Here, the error factor may be an error value for at least one of the weight, center of gravity, thrust, and moment of inertia of the guided missile.

As illustrated in FIGS. 4 and 5, the information on an expected trajectory of the guided missile may include a left trajectory L-path, a right trajectory R-path, a top trajectory T-path, and a bottom trajectory B-path with respect to the launch direction of the guided missile.

A method of generating information on an expected trajectory of a guided missile will be briefly described as follows. First, when a Gaussian random function is calculated for one or more error factors of a guided missile, and a simulation for the resulting values, for example, a Monte Carlo simulation, is performed, a plurality of expected trajectories E-path including error factors can be generated as illustrated in FIGS. 4 and 5.

Subsequently, the plurality of expected trajectories E-path may be converted into a plurality of spatial trajectories in the launch direction of the guided missile, and edge trajectories in upward/downward/leftward/rightward directions among the plurality of spatial trajectories may be extracted as a top trajectory T-path, a bottom trajectory B-path, a left trajectory L-path, and a right trajectory R-path.

Then, information on an expected trajectory of the guided missile including the extracted top trajectory T-path, bottom trajectory B-path, left trajectory L-path, and right trajectory R-path may be generated and stored in the expected trajectory storage unit 150 included in the electronic device of the guided missile.

Meanwhile, reference numeral I-path which is shown in FIGS. 4 and 5 but not described may be an expected trajectory that does not include an error factor among expected trajectories generated through the above-described simulation.

As described above, since information on an expected trajectory of a guided missile of the present embodiment is calculated through a simulation based on one or more error factors generated in the guided missile manufacturing process, the information can be generated by a device such as a separate computer in consideration of a simulation time.

In addition, since expected trajectory information on a plurality of guided missiles may be different, expected trajectory information on each guided missile may be stored in the electronic device of the corresponding guided missile, and the pre-calculated expected trajectory information on the guided missile may be output to the topographical interference determination apparatus 100 of the launcher LM when the guided missile is loaded in the launcher LM.

Referring back to FIG. 3, the processor 110 of the topographical interference determination apparatus 100 may execute the topographical interference determination program 140 after the information on the expected trajectory of the guided missile is obtained. In addition, the pre-calculated expected trajectory information adjustment unit 141 may adjust and output the obtained expected trajectory information based on the distance between the current location of the launcher LM and a target.

Accordingly, the pre-calculated expected trajectory information output from the pre-calculated expected trajectory information adjustment unit 141 may include spatial trajectories in upward/downward/leftward/rightward directions from the launch point of the guided missile, that is, the location of the launcher LM, and the location of the target, as illustrated in FIGS. 4 and 5.

Subsequently, the topographic elevation extraction unit 142 may extract topographic elevations of the guided missile launching area based on the pre-calculated expected trajectory information on the guided missile and the topographical information on the launch area (S20).

The topographic elevation extraction unit 142 may extract the topography of topographical information corresponding to the pre-calculated expected trajectory information from topographical information. Here, the topographic elevation extraction unit 142 may extract the topography of topographical information corresponding to the area between the left and right trajectories of the pre-calculated expected trajectory information from the topographical information.

Subsequently, the topographic elevation extraction unit 142 may divide the extracted topography at regular intervals, for example, at intervals of 1 to 10 m in a direction intersecting the launch direction of the guided missile and extract topographic elevations including elevation values for a plurality of divided topography regions.

Subsequently, as illustrated in FIG. 6, the topographical interference determination unit 143 may match the extracted topographic elevations with the bottom trajectory of the pre-calculated expected trajectory information (S30).

Then, topographical interference with the guided missile can be determined by comparing a plurality of topographic elevation values of the topographic elevations with a plurality of bottom trajectory elevation values of the bottom trajectory corresponding thereto (S40).

For example, the topographical interference determination unit 143 may determine topographical interference with respect to the guided missile when at least one pair of elevation values corresponding to each other among the plurality of bottom trajectory elevation values and the plurality of topographic elevation values matches.

Further, the topographical interference determination unit 143 may determine topographical interference with respect to the guided missile when the difference between each of the plurality of bottom trajectory elevation values and each of the plurality of topographic elevation values corresponding thereto is a negative number.

In addition, as shown in FIG. 6, the topographical interference determination unit 143 may calculate distances D between the plurality of bottom trajectory elevation values and the plurality of topographic elevation values corresponding thereto and compare the calculate the distances D with a preset reference value. If at least one of the plurality of distances D is equal to or less than the reference value as a result of comparison, the topographical interference determination unit 143 may determine topographical interference with respect to the guided missile.

Accordingly, the processor 110 may generate a predetermined launch control signal based on the topographical interference determination result of the topographical interference determination unit 143. The processor 110 may output the launch control signal to the guided missile launch controller unit 170 such that the guided missile launch controller unit 170 can control a launch angle and launch the guided missile or stop guided missile launch (S50).

As described above, in the present embodiment, it is possible to determine in advance whether or not interference is present between a guided missile and a topography before launching the guided missile based on information on an expected trajectory of the guided missile and topographical information on a launch area.

Accordingly, the launch angle of the guided missile can be adjusted based on the result of determination of topographical interference with the guided missile or control is performed such that launch is stopped in the launcher LM, and thus it is possible to prevent the launched missile from being lost due to topographical interference before reaching a target on the ground.

Combinations of steps in each flowchart attached to the present disclosure may be executed by computer program instructions. Since the computer program instructions can be mounted on a processor of a general-purpose computer, a special purpose computer, or other programmable data processing equipment, the instructions executed by the processor of the computer or other programmable data processing equipment create a means for performing the functions described in each step of the flowchart. The computer program instructions can also be stored on a computer-usable or computer-readable storage medium which can be directed to a computer or other programmable data processing equipment to implement a function in a specific manner. Accordingly, the instructions stored on the computer-usable or computer-readable storage medium can also produce an article of manufacture containing an instruction means which performs the functions described in each step of the flowchart. The computer program instructions can also be mounted on a computer or other programmable data processing equipment. Accordingly, a series of operational steps are performed on a computer or other programmable data processing equipment to create a computer-executable process, and it is also possible for instructions to perform a computer or other programmable data processing equipment to provide steps for performing the functions described in each step of the flowchart.

In addition, each step may represent a module, a segment, or a portion of codes which contains one or more executable instructions for executing the specified logical function(s). It should also be noted that in some alternative embodiments, the functions mentioned in the steps may occur out of order. For example, two steps illustrated in succession may in fact be performed substantially simultaneously, or the steps may sometimes be performed in a reverse order depending on the corresponding function.

The above description is merely exemplary description of the technical scope of the present disclosure, and it will be understood by those skilled in the art that various changes and modifications can be made without departing from original characteristics of the present disclosure. Therefore, the embodiments disclosed in the present disclosure are intended to explain, not to limit, the technical scope of the present disclosure, and the technical scope of the present disclosure is not limited by the embodiments. The protection scope of the present disclosure should be interpreted based on the following claims and it should be appreciated that all technical scopes included within a range equivalent thereto are included in the protection scope of the present disclosure.

What is claimed is:

1. A method of determining topographical interference with a guided missile to be performed by an apparatus for determining topographical interference with a guided missile, the method comprising:

obtaining pre-calculated expected trajectory information of a guided missile;

extracting topographic elevations with respect to a topography corresponding to the pre-calculated expected trajectory information from stored topographical information; and determining presence or absence of topographical interference with the guided missile based on a plurality of bottom trajectory elevation values in the pre-calculated expected trajectory information and a plurality of topographic elevation values of the topographic elevations corresponding to the plurality of bottom trajectory elevation values, wherein the pre-calculated expected trajectory information includes a top trajectory, a bottom trajectory, a left trajectory, and a right trajectory with respect to a launch direction of the guided missile, calculated based on one or more error factors for the guided missile, and wherein the one or more error factors comprise manufacturing error values with respect to at least one of a weight, center of gravity, a thrust, or a moment of inertia of the guided missile.

2. The method of claim 1, wherein extracting the topographical elevations comprises:

extracting a topography corresponding to an area between the left trajectory and the right trajectory in the pre-calculated expected trajectory information from the topographic information;

dividing the extracted topography at regular intervals; and extracting the topographic elevations including topographic elevation values for a plurality of division points of the extracted topography.

3. The method of claim 2, wherein dividing the extracted topography at regular intervals comprises:

dividing the extracted topography at intervals of 1 m to 10 m based on a launch point of the guided missile.

4. The method of claim 1, wherein determining the presence or absence of topographical interference with the guided missile comprises:

determining topographical interference with the guided missile is present when at least one pair of elevation values corresponding to each other among the plurality of topographic elevation values and the plurality of bottom trajectory elevation values matches.

5. The method of claim 1, wherein determining the presence or absence of topographical interference with the guided missile comprises:

determining topographical interference with the guided missile is present when a difference between at least one pair of elevation values corresponding to each other among the plurality of topographic elevation values and the plurality of bottom trajectory elevation values is a negative number.

6. The method of claim 1, wherein determining the presence or absence of topographical interference with the guided missile comprises:

calculating a plurality of distances for the plurality of topographic elevation values and the plurality of bottom trajectory elevation values; and determining topographical interference with the guided missile is present when at least one of the plurality of distances is equal to or less than a preset reference value.

7. The method of claim 1, further comprising adjusting the pre-calculated expected trajectory information based on a distance between the launch point of the guided missile and a target.

8. The method of claim 1, further comprising controlling launch of the guided missile based on a result of determination of topographical interference with the guided missile.

9. An apparatus for determining topographical interference with a guided missile, comprising:

a memory storing instructions; and a processor configured to execute the instructions to:

obtain a pre-calculated expected trajectory information of the guided missile, extract topographic elevations with respect to a topography corresponding to the pre-calculated expected trajectory information from among stored topographical information, and determine presence or absence of topographical interference with the guided missile based on a plurality of bottom trajectory elevation values in the pre-calculated expected trajectory information and a plurality of topographic elevation values of the topographic elevations corresponding to the plurality of bottom trajectory elevation values, wherein the pre-calculated expected trajectory information includes a top trajectory, a bottom trajectory, a left trajectory, and a right trajectory with respect to a launch direction of the guided missile, calculated based on one or more error factors for the guided missile, and wherein the one or more error factors comprise manufacturing error values with respect to at least one of a weight, center of gravity, a thrust, or a moment of inertia of the guided missile.

10. The apparatus of claim 9, wherein the processor is configured to extract a topography corresponding to an area between the left trajectory and the right trajectory in the pre-calculated expected trajectory information from the topographic information, to divide the extracted topography at regular intervals based on a launch point of the guided missile, and to extract the topographic elevations including topographic elevation values for a plurality of division points of the extracted topography.

11. The apparatus of claim 10, wherein the processor is configured to divide the extracted topography at intervals of 1 m to 10 m based on the launch point of the guided missile.

12. The apparatus of claim 9, wherein the processor is configured to determine topographical interference with the guided missile is present when at least one pair of elevation values corresponding to each other among the plurality of topographic elevation values and the plurality of bottom trajectory elevation values matches.

13. The apparatus of claim 9, wherein the processor is configured to determine topographical interference with the guided missile is present when a difference between at least one pair of elevation values corresponding to each other among the plurality of topographic elevation values and the plurality of bottom trajectory elevation values is a negative number.

14. The apparatus of claim 9, wherein the processor is configured to calculate a plurality of distances for the plurality of topographic elevation values and the plurality of bottom trajectory elevation values and to determine topographical interference with the guided missile is present when at least one of the plurality of distances is equal to or less than a preset reference value.

15. The apparatus of claim 9, wherein the processor is configured to execute the topographical interference determination program to determine topographical interference with the guided missile before a launcher launches the guided missile, and to output a launch control signal for controlling launch of the guided missile to a guided missile launch controller based on a determination result.

16. The apparatus of claim 9, wherein the processor is configured to adjust the pre-calculated expected trajectory information based on a distance between the launch point of the guided missile and a target.

17. A non-transitory computer-readable storage medium storing instructions, when executed by a processor, configured to perform a method comprising:

obtaining a pre-calculated expected trajectory information of a guided missile;

extracting topographic elevations with respect to a topography corresponding to the pre-calculated expected trajectory information from stored topographical information; and determining presence or absence of topographical interference with the guided missile based on a plurality of bottom trajectory elevation values in the pre-calculated expected trajectory information and a plurality of topographic elevation values of the topographic elevations corresponding to the plurality of bottom trajectory elevation values, wherein the pre-calculated expected trajectory information includes a top trajectory, a bottom trajectory, a left trajectory, and a right trajectory with respect to a launch direction of the guided missile, calculated based on one or more error factors for the guided missile, and wherein the one or more error factors comprise manufacturing error values with respect to at least one of a weight, center of gravity, a thrust, or a moment of inertia of the guided missile.

18. The non-transitory computer-readable storage medium of claim 17, wherein extracting the topographical elevations comprises:

extracting a topography corresponding to an area between the left trajectory and the right trajectory in the pre-calculated expected trajectory information from the topographic information;

dividing the extracted topography at regular intervals; and extracting the topographic elevations including topographic elevation values for a plurality of division points.

19. The non-transitory computer-readable storage medium of claim 18, wherein dividing the extracted topography at regular intervals comprises:

dividing the extracted topography at intervals of 1 to 10 m based on a launch point of the guided missile.

20. The non-transitory computer-readable storage medium of claim 17, wherein determining the presence or absence of topographical interference with the guided missile comprises determining topographical interference with the guided missile is present when at least one pair of elevation values corresponding to each other among the plurality of topographic elevation values and the plurality of bottom trajectory elevation values matches.

* * * * *